United States Patent [19]

Niemann

[11] 4,053,154

[45] Oct. 11, 1977

[54] HOMICIDE BOARD GAME

[76] Inventor: Henry P. Niemann, 305 W. 18th St., Apt. 2-A, New York, N.Y. 10011

[21] Appl. No.: 689,639

[22] Filed: May 24, 1976

[51] Int. Cl.[2] ..... A63F 3/00

[52] U.S. Cl. ..... 273/134 B; 273/134 C; 273/134 D; 273/148 A

[58] Field of Search ..... 273/134

[56] References Cited

U.S. PATENT DOCUMENTS

| | | | |
|---|---|---|---|
| 3,942,800 | 3/1976 | Holbrook | 273/134 C X |
| 3,955,818 | 5/1976 | Hawke | 273/134 AC |
| 3,977,680 | 8/1976 | Lavine | 273/134 C |

FOREIGN PATENT DOCUMENTS

| | | | |
|---|---|---|---|
| 1,261,391 | 4/1961 | France | 273/134 AD |
| 1,261,392 | 4/1961 | France | 273/134 AD |

*Primary Examiner*—Delbert B. Lowe
*Attorney, Agent, or Firm*—Marden S. Gordon

[57] ABSTRACT

A board game apparatus wherein each player is a detective who, through a multitude of clues, attempts to find the murderer through a process of elimination of potential suspects; the game including a playing board having playing paths representing streets surrounding the periphery thereof, a multitude of squares disposed along such playing paths representative of suspects' homes with each home having three distinctive leads marked on the playing space therewith; three decks of cards representing Weapon, Clue and Motive which are placed face down in appropriate locations on three of the corners of the game board; a dead body marker to be placed on the home space having the victim's name thereon with the detective players having to determine who killed the victim; a die for determining the number of spaces to be moved by each player on each turn; tokens or markers for marking a player's position on the game board; and a plurality of detective Notebook Sheets for use in recording the names of the persons visited by the detective in determining those which are suspect and for eventually determining by deductive reasoning the name of the killer; the winner of the game being the first to successfully determine the name of the killer or, alternatively, being the last player left on the board after all players have unsuccessfully attempted to name the killer, doing so with an incorrect name.

1 Claim, 12 Drawing Figures

36
27
36
33
33a
PARK
MEMORY LA.
MOTIVE
33'
11
MAPLE ST.
35
SLEEPY LA.
36
25
28
22
ICIDE
BROAD AV.
CANAL ST.
36
23
40
MYRTLE RD.
36
MAIN ST.
34'
SPINDLE RD.
TINKER LA.
34
CLUE
34a
36
2ND AV.
36
29

FIG. 8
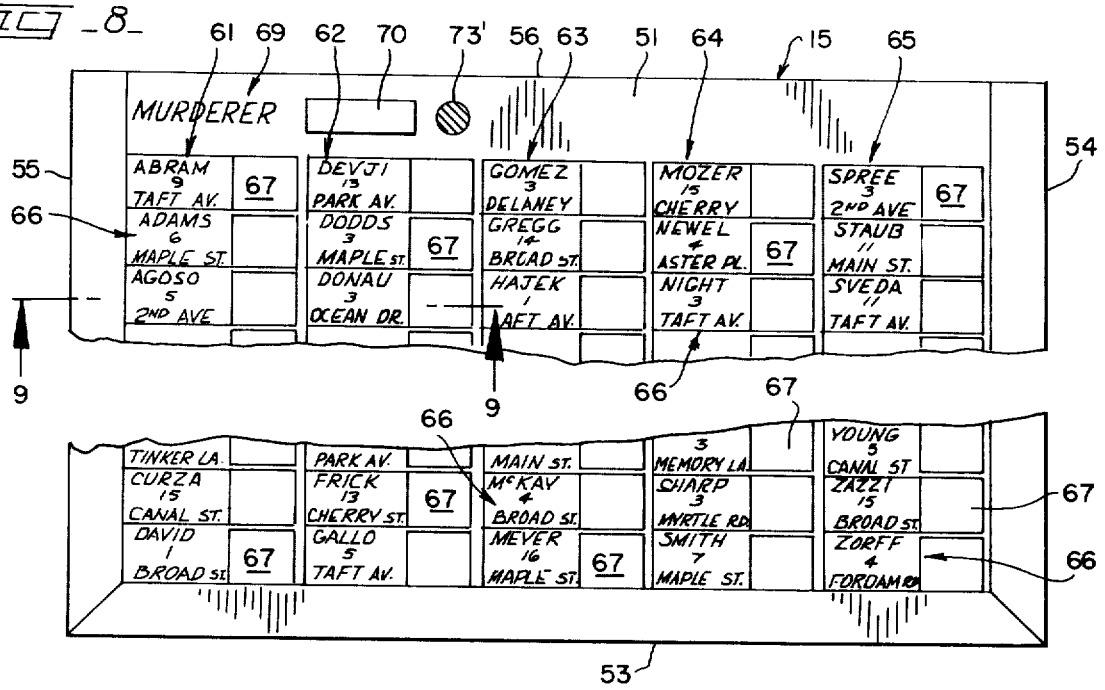
FIG. 9
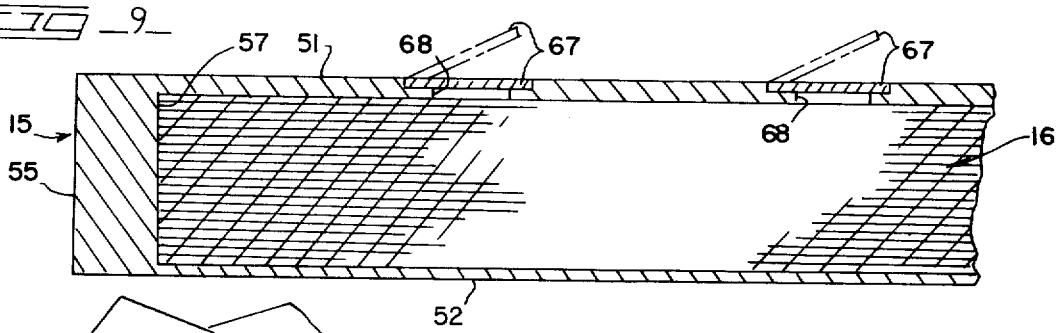
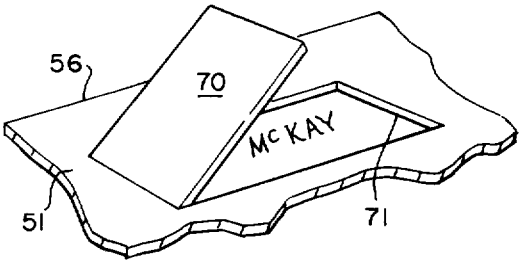
FIG. 10
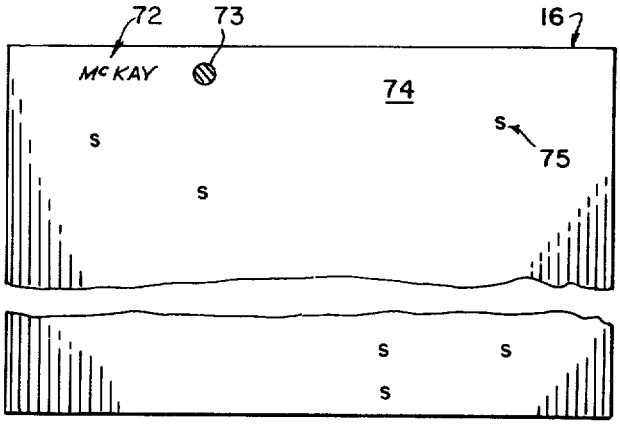
FIG. 11
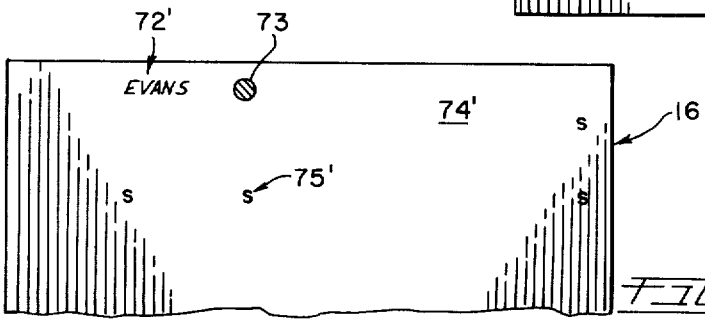
FIG. 12

HOMICIDE BOARD GAME

BACKGROUND OF THE INVENTION

1. Field of the Invention

This invention relates generally to board games and more particularly to a novel board game in which tokens or markers are moved about the playing surface of the game board by the players who act as detectives interrogating individuals whose names are on the game board to determine those who are suspect and those who are not suspect, the player recording such names on a Notebook Sheet in a manner permitting deductive reasoning to result in determining the name of the killer, the player's movement about the playing board being determined by a throw of a die indicating the number of spaces to be moved on each turn.

2. Description of the Prior Art

The popularity of board games among individuals of all ages has long been known, with some games becoming classics due to their popularity as family-type games, such as Monopoly, Clue and the like. It has been found that the most popular of such board games among individuals require a combination of skill and luck such that all members of various ages of a family group can compete against each other on a somewhat equal basis during the play of the game. Among examples of prior art board games are those of Freedman U.S. Pat. No. 2,165,891; Thomas U.S. Pat. No. 2,178,330; Glass U.S. Pat No. 3,169,768; and Caffrey U.S. Pat. No. 2,852,260.

SUMMARY OF THE INVENTION

The present invention recognizes the popularity of family-type board games and provides a novel board game playable by a plurality of players of a variety of ages in a manner in which the interest of the players is maintained and increased during the play of the game by reason of the suspense involved in working out the objective, in that each player takes the part of a detective who, through the play of the game, uncovers a multitude of clues in attempting to determine the murderer of the named victim in order to be declared the winner of the game.

It is a feature of the present invention to provide an interesting and intriguing board game playable by a plurality of players and requiring the use of deductive reasoning to determine the name of the murderer of the victim, thus providing both an entertaining and educational play experience to the players.

Among the features and advantages of the present invention are the provision of a board game which is relatively simple in its construction and which therefore may be readily manufactured at a relatively low cost and by simple manufacturing methods so as to be able to be retailed at a sufficiently low price to encourage its widespread purchase and acceptance; one which is of a rugged and durable construction and which therefore may be guaranteed by the manufacturer to withstand many years of intended usage; one which is of an aesthetically pleasing and refined appearance; one which is easy to learn to play, requiring a minimum of instruction and thus enhancing initial interest on the part of the players; one which is provided with chance means providing a wide range of potential murderers and potential victims such that each play of the game provides different results from the former play of the game, such results being determined by chance; and one which is otherwise well adapted to perform the entertaining and educational services required of it.

Other features and advantages of this invention will be apparent during the course of the following description.

BRIEF DESCRIPTION OF THE DRAWINGS

In the accompanying drawings forming a part of this specification, and in which like reference characters are employed to designate like parts throughout the same:

FIG. 8 is a fragmentary top plan view of the Police File apparatus;

FIG. 9 is an enlarged cross-sectional view taken along Line 9—9 of FIG. 8;

FIG. 10 is a fragmentary top perspective view of a portion of the top surface of the Police File;

FIG. 11 is a fragmentary top plan view of a typical Murderer Sheet for use in the Police File; and FIG. 12 is a top plan view similar to FIG. 11 of a Murderer Sheet naming a different murderer.

DESCRIPTION OF THE PREFERRED EMBODIMENT

Figure 1:
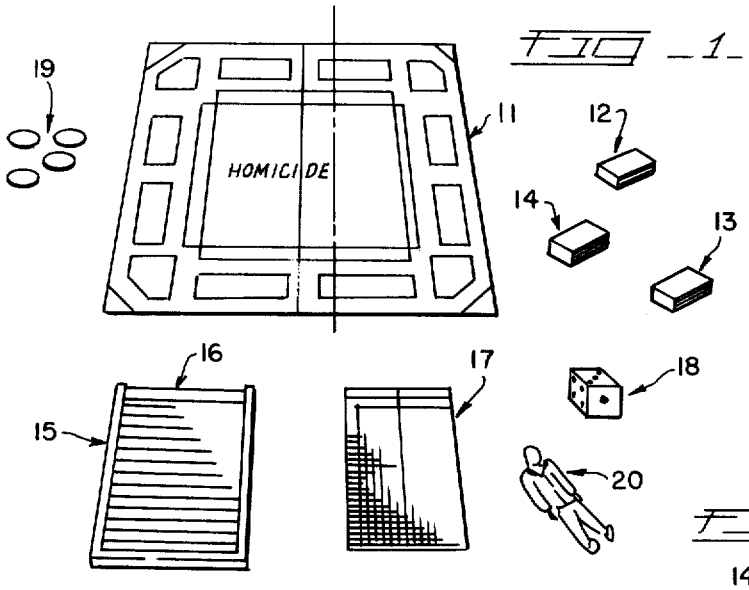
FIG. 1 is a perspective view of the board game apparatus of the present invention.

Referring now to the drawings in detail a preferred form of a Homicide Board Game is illustrated along with playing apparatus associated therewith, this being constructed in accordance with the principles of the invention and comprised of a game board 11, a deck of Clue cards 12, a deck of Weapon cards 13, a deck of Motive cards 14, a Police File 15, a plurality of Murderer Sheets 16 of a size and configuration to be contained in a concealed manner within the Police File, a plurality of detective Notebook Sheets 17, a chance device in the form of a die 18, a plurality of tokens or markers 19 for use by the players in marking their positions on the game board 11, and a toy figure 20 representing a dead body for designating the victim on the surface of the game board as will be later described.

Figure 6:
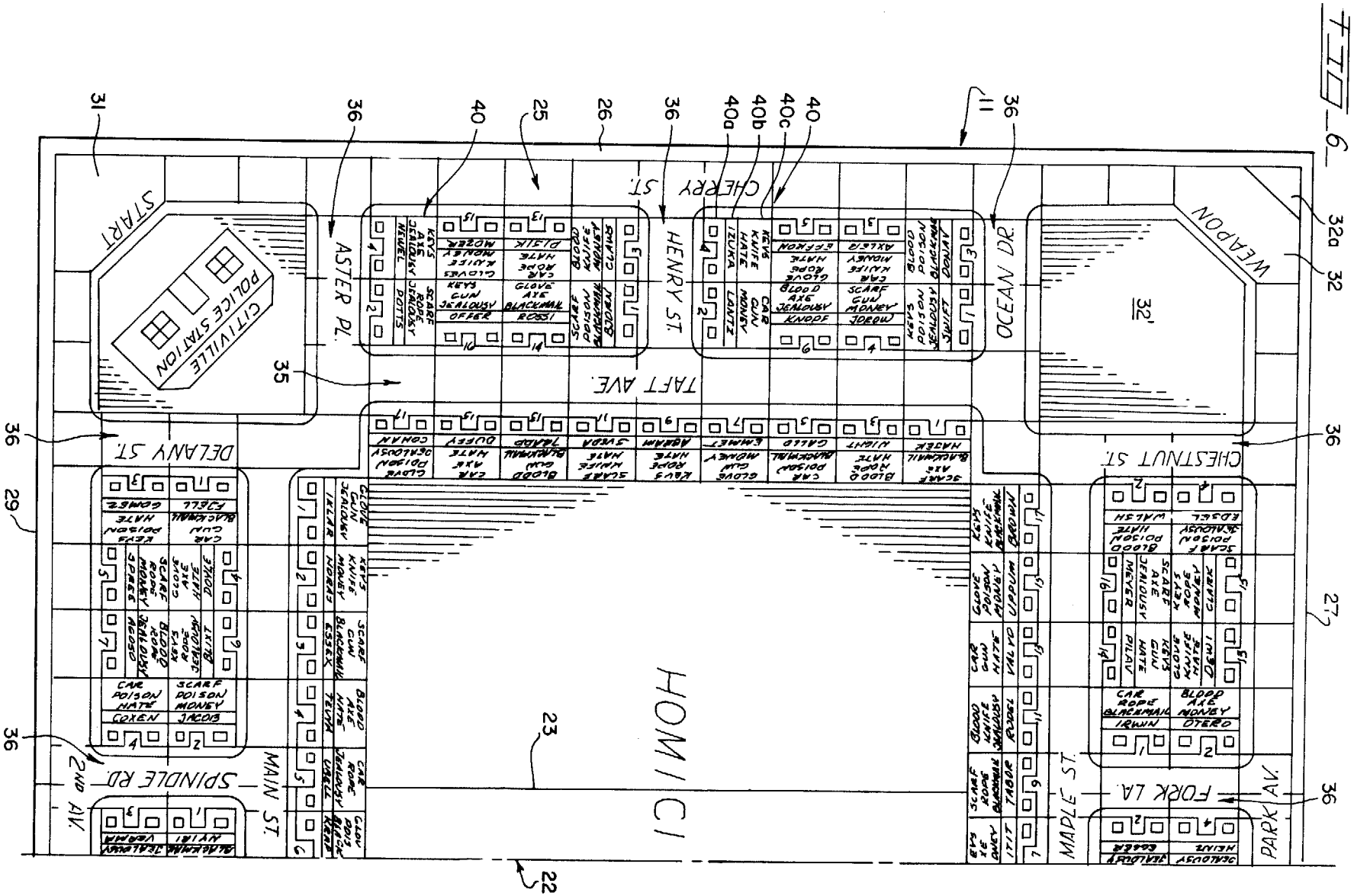
FIG. 6 is a top plan view of one half of the playing surface of the game board.
Figure 7:
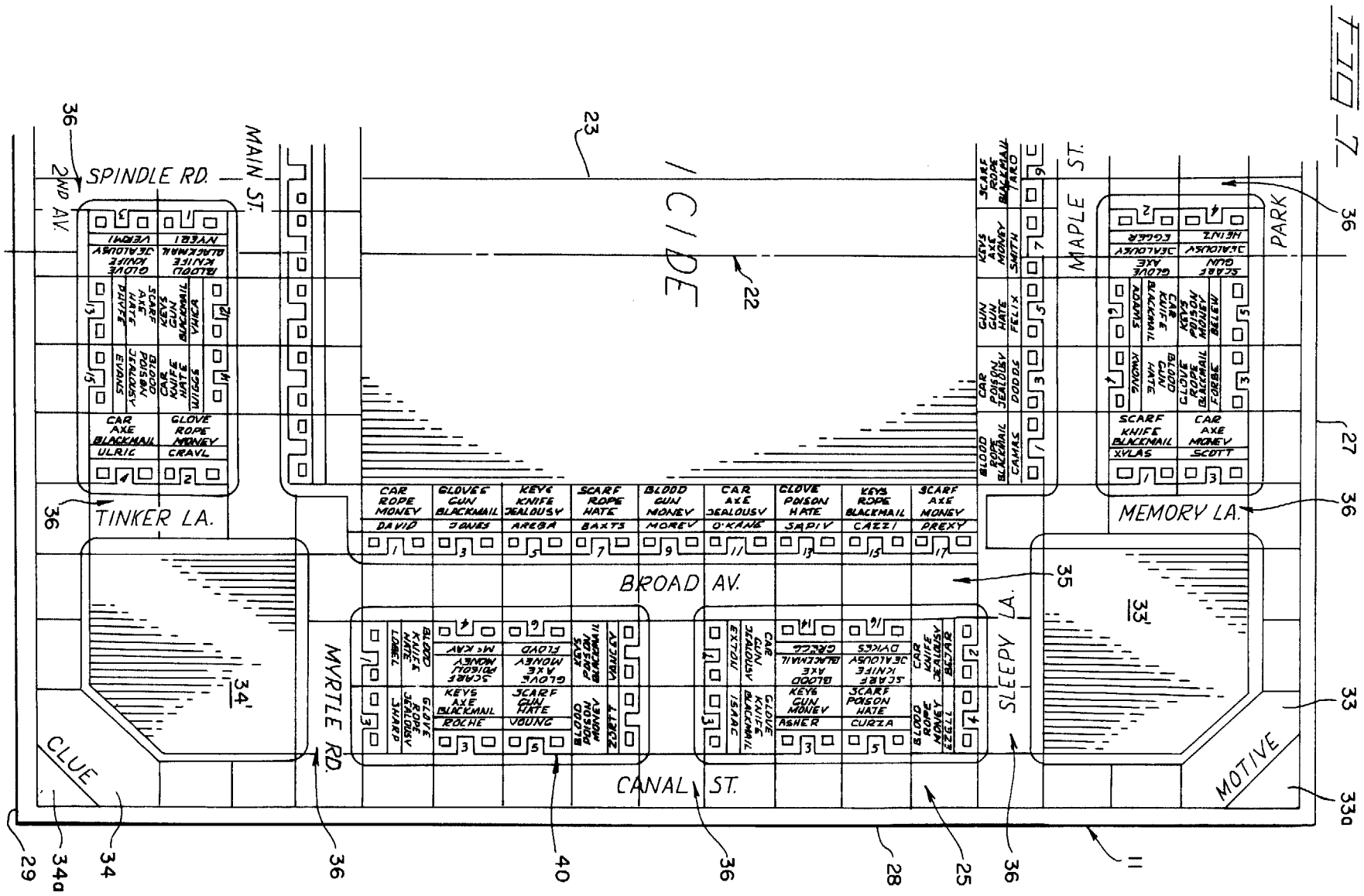
FIG. 7 is a top plan view of the remaining half of the playing surface of the game board.

Referring to FIGS. 6 and 7 there is illustrated the game board 11 which, for purposes of illustration, has been divided along a division line designated by reference numeral 22 into two segments for ease of illustration. The game board is manufactured of a flat sheet of material having a playing surface imprinted on the top thereof or, alternatively, having the playing surface imprinted on a sheet of paper which is then adhesively applied to the top surface of the board. In either event, the board is divided into half sections which are foldable about central fold line 23 onto each other for ease of handling and storage of the game board between times of usage.

The playing surface of game board 11 consists of a first track 25 of side-by-side consecutive squares spaced about the perimeter edges 26, 27, 28 and 29 of the game board, such squares denoting spaces for the movement of the players' markers 19 therealong. The squares meet at the corners 31, 32, 33 and 34 of the game board, with corner 31 being designated as the Police Station and also having the marking "START" contained thereon and indicating the place at which all players initially start the play of the game. The corner 32 is marked "WEAPON" and includes a somewhat square area 32' for the placement of the deck of Weapon Cards 13 in a face-down manner thereon. The corner 33 is marked "MOTIVE" and includes a somewhat square area 33' for the placement of the deck of Motive Cards 14 in a face-down manner thereon. The corner 34 is marked "CLUE" and includes a somewhat square space 34' for the placement of the deck of Clue Cards 12 in a face-down manner thereon. In addition, each of the corners 32-34 may include a triangular colored segment **32*a*, 33*a* and 34*a*. These segments may be colored to correspond to the colors of the decks of cards 12-14 to indicate the placement of such cards on the game board. The coloring may be provided for convenience if desired but it does not form a part of the inventive concept. The triangle 32*a* may be of a red color with the Weapon Cards 13 including red markings thereon or being imprinted on red paper, or the like. Similarly, triangle 33*a* may be colored blue and triangle 34*a* may be colored black for similar type identification of the Motive and Clue decks of cards 14 and 12** respectively.

Disposed generally concentric with first track 25 and spaced inwardly on the game board 11 relative thereto is a second track 35 of consecutive side-by-side squares which are vertically and horizontally aligned with the squares of the first track and which are connected to the first track by a series of interconnecting roadways 36 formed of squares. The tracks 25, 35 and 36 define a roadway-type path extending completely about the perimeter of the game board with there being disposed along such paths a multitude of squares with a designation of a home, the individual's name living in the home being imprinted on the square, and a series of three so-called "leads" being imprinted on each square directly above the individual's name. As seen in FIG. 6, a typical square 40 has the house portion designated by reference numeral **40*a*, the individual's name portion designated by reference numeral 40*b*, and the three leads designated by reference numeral 40*c*. In addition, it is noted that each of the homes face on only one of the roadways 25, 35 and 36 with it being possible while traveling some of the roadways 35 and some of the roadways 36** for an individual to be able to select a house on either side of the roadway for interrogation as will be later described.

As to the "leads" identified by reference numeral **40*c* and found in each of the squares 40, these leads are a combination of one of the Weapons, one of the Motives and one of the Clues, with such combination being unique and distinct for each of the individuals listed on the board, with each individual having only a single listing on the board such that for each individual 40*b* there are three distinct and unique clues 40*c* which are distinctly and uniquely associated with the individual's house 40*a***.

Figure 2:
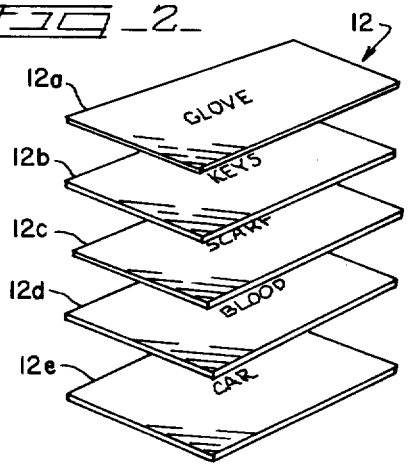
FIG. 2 is a perspective view of the deck of five Clue cards.

As seen in FIG. 2, there are provided five Clue Cards designated by reference numerals **12*a*, 12*b*, 12*c*, 12*d* and 12*e* with such cards each being of an identical flat rectangular configuration having common back sides and with the face surfaces thereof each individually marked with the names of separate clues as seen in the drawings, these being "GLOVE," "KEYS," "SCARF," "BLOOD" and "CAR." As aforementioned, these cards may be color coded to be placed on square 34' of game board 11** or, alternatively, the back sides of such cards may be identified by the wording "CLUE."

Figure 3:
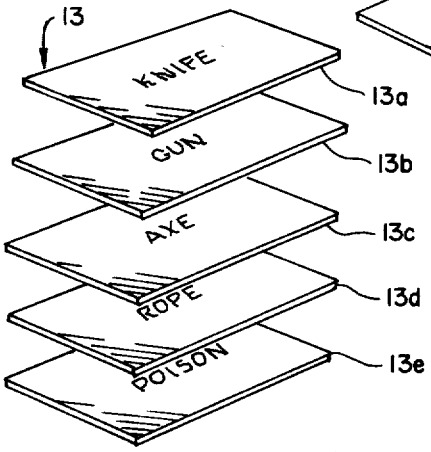
FIG. 3 is a perspective view of the deck of five Weapon cards.

As seen in FIG. 3, the Weapon Cards 13 number five in total which are designated by reference numerals **13*a*, 13*b*, 13*c*, 13*d* and 13*e*, with each of the cards being of an identical flat rectangular configuration having common back surfaces and with each face surface marked with the name of a unique weapon as illustrated in the drawings and which are "KNIFE," "GUN," "AXE," "ROPE" and "POISON." As aforementioned, the Weapon Cards 13 are intended to be shuffled and placed down on square 32' of the game board 11, with the Weapon Cards being coded corresponding to the coding of triangle 32*a*** (e.g., the back sides thereof being identified by the wording "WEAPON").

Figure 4:
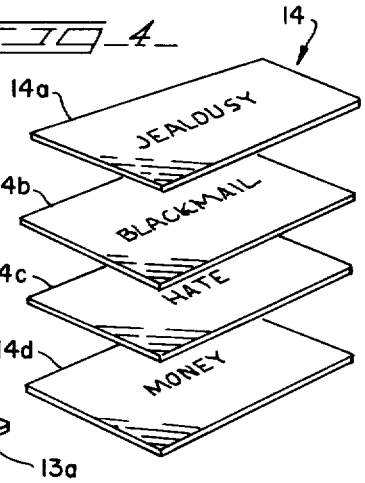
FIG. 4 is a perspective view of the deck of four Motive cards.

Referring to FIG. 4 it is seen that the Motive Cards number four in total which are designated by reference numerals **14*a*, 14*b*, 14*c* and 14*d*, each of the cards being of an identical flat rectangular configuration having a common back surface with each face surface marked with the names of a different motive as seen in the drawings, these being "JEALOUSY," "BLACKMAIL," "HATE" and "MONEY." The Motive Cards are intended to be shuffled and placed face down on square 33' of the game board 11. The Motive Cards may be colored to correspond to the color of triangle 33*a*** of the game board to indicate the proper placement of the cards on the game board, or the back sides may be marked with the wording "MOTIVE" to identify the cards.

The Police File 15 comprises a hollow rectangularly shaped file box open at its top end for receipt of the Murderer Sheets 16 therein in stacked relationship relative to each other, the Police File consisting of a horizontal flat top surface 51, a horizontal flat bottom surface 52, vertical bottom side walls 53, opposed vertical edge side walls 54 and 55, an open top edge side wall 56 providing access to a rectangular compartment 57 formed inwardly of the surfaces 51-55 and of a size and configuration to receive the stacked Murderer Sheets 16 therein. The top surface 51 is divided into five vertical columns 61, 62, 63, 64 and 65 with each column divided into 20 squares designated generally by reference numeral 66, the squares 66 each being horizontally aligned with an adjacent square 66 of the next adjacent column. Each of the squares 66 is identified by an individual's name and the address corresponding to the individual's square 40 on the game board 11 with there being a total of 100 of the squares 40 and a corresponding 100 of the correspondingly-identified squares 66. Disposed immediately adjacent and to the side of each square 66 is a hinged flap or door 67 which covers an opening or doorway associated with each of the squares 66 and which opens through surface 51 in communication with the compartment 57. In addition, disposed on top surface 51 adjacent top edge 56 in a corner segment is the wording "MURDERER" 69 having adjacent thereto a hinged flap or door 70 for covering an opening 71 in communication with compartment 57 to provide selective opening of such door to view that which is exposed in the slotted opening 71 as will be later described.

A Murderer Sheet 16 is provided for each of the individuals named on the squares 66 and 40 such that a total of 100 Murderer Sheets are provided, each sheet being of a flat rectangular configuration having a top surface imprinted in one corner with the individual's name 72 and having a top surface indicator marking 73 adjacent the name which is visible through a circular aperture 73' in file top surface 51, the aperture being disposed immediately adjacent the doorway 70 such that an individual can determine that the Murderer Sheet 16 disposed immediately beneath the top surface 51 in the compartment 57 is facing upward in the proper direction as the markings 73 will show through the aperture 73'. The remaining top surface 74 of each Murderer Sheet 16 is marked with a multiplicity of the letter "S" designated generally by reference numeral 75, such markings corresponding with some of the openings 68 of top surface 51 such that when the Murderer Sheet is beneath the top surface an individual upon opening doorway 67 associated with an individual being interrogated by the player will expose the marking "S" designating that such individual is a suspect and is to be marked accordingly on the player's Notebook Sheet 17, and if no marking "S" appears in opening 68 adjacent an individual's name square 66, then the player knows that such individual is not a suspect and notes it accordingly on the Notebook Sheet. The manner of notation of such individuals on the Notebook Sheet 17 being later described. It is noted that the individual's name 72 on the Murderer Sheet is printed to be disposed beneath opening 71 of file top surface 51 and thus hidden by flap 70, with such name being uncovered only when an individual player feels he knows the name of the murderer, with only that player looking at the name such that if the player is incorrect the player is now out of the game with the remaining players continuing with the play of the game as will be later described.

The 100 Murderer Sheets 16 are shuffled together and then placed in stacked arrangement in the Police File compartment 57 with the top sheet thereof immediately beneath top surface 51 such that marking 73 is visible through aperture 73', and at this time the Police File is ready for use in the game with the top sheet representing the Murderer which must be discovered by the player detectives during the play of the game.

It is to be noted that FIG. 11 is a Murderer Sheet 16 for the individual McKAY, with FIG. 12 representing a Murderer Sheet 16 for the individual EVANS 72' having a marking 73 thereon on top surface 74' with the letters "S" 75' being scattered thereabout to identify suspects relative to the squares 66 in the same manner as aforedescribed.

Figure 5:
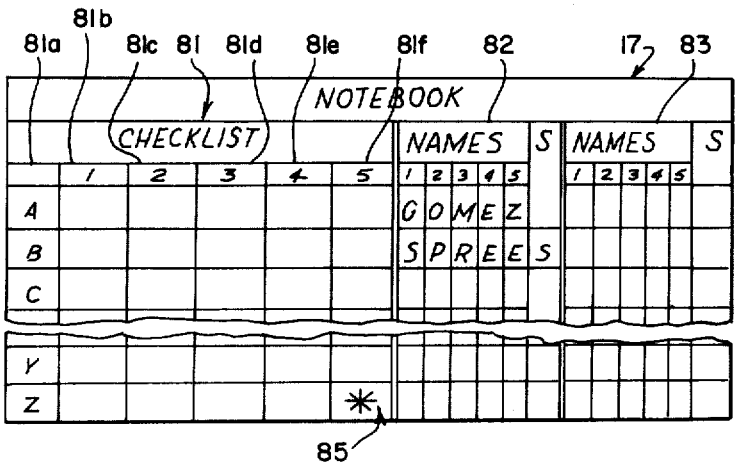
FIG. 5 is a fragmentary top plan view of a detective Notebook Sheet.

Referring now to FIG. 5 there is illustrated a typical Notebook Sheet 17 which is of a rectangular flat configuration imprinted on a paper sheet with such sheets preferably provided in bound pads for ease in tearing off and dispensing one sheet to each of the player detectives. The surface of each sheet 17 is divided into three major vertical columns 81, 82 and 83, with each of the columns being further subdivided into vertical columns and with such vertical columns being divided by horizontal lines so as to define rows of vertical squares for each of the columns. The column 81 is divided into six vertical rows **81*a*, 81*b*, 81*c*, 81*d*, 81*e* and 81*f* with the rows 81*b*–81*f* being identified at the very tops thereof by the numbers 1 through 5 respectively. The horizontal lines divide the rows 81*a*–81*f* into 26 squares with the column 81*a* having its squares containing the letters of the alphabet from "A" through "Z." The columns 82 and 83 are identical such that only column 82 will be described in detail. Column 82 is divided into six vertical rows with the first five rows identified by the numbers 1 through 5 respectively and with the sixth row identified by the letter "S," with each of the six rows divided by the aforementioned horizontal lines such that each row contains 26 vertical squares. The column 81 is entitled at its top "CHECK LIST," with the columns 82 and 83 each being identified by the wording "NAMES." In this regard it is to be noted that each of the individual's names listed on the playing board in squares 40 and listed correspondingly in squares 66 on the Police File 15 have a total of five letters making up the name so that it is seen that each name can be fully written horizontally across column 82 or 83 such that each letter of the name is in a different one of the columns numbered 1–5**, with the columns headed "S" representing the expression "SUSPECT" with a player detective inserting a letter "S" in this column after an individual's name if such individual has been indicated as a suspect by the Police File, the manner of determining this being later described.

To play the game, the game board 11 is opened with the decks of the cards 12–14 shuffled and placed on their respective locations 32', 33' and 34' of the game board in a face-down manner, the Murderer Sheets 16 are shuffled and inserted into the Police File 15 with the sheet disposed immediately beneath the file top surface 51 designating the Murderer who must be discovered by the player detectives. Each of the player detectives is then given a detective Notebook Sheet 17 and a pencil for writing thereon.

One of the player detectives then draws a card from each of the decks 12, 13 and 14 and places the drawn card from each deck face up in front of him. These three cards are referred to as "leads" and, upon comparison with the three leads found on each of the squares 40, the player detectives locate the name of the individual corresponding to such three leads. This individual is termed the murdered person or the victim with such then being designated by the dead body 20 being placed on the appropriate square 40 designating the victim's home. That home and the name of the individual is then closed to interrogation and no player may enter the home during the play of the game. Each of the cards drawn from the decks 12, 13 and 14 is then reshuffled into the deck and returned to the game board.

To determine the order of play of the game, each player rolls the die 18 with the player rolling the highest number of the die going first, and with the play then proceeding clockwise about the game board as the players take their successive turn.

Each player is assigned one of the tokens or markers 19 which are distinctively different from each other and which, while being generally illustrated as disc shaped, may be representative of detectives or the like of either distinctive shape, distinctive colors, or a combination thereof so that each of the player detectives can determine their own token or marker.

After the throw of the die, a player is then free to move his marker from the Start position designated by reference numeral 31 in any desired direction along the roadways 25, 35 and 36 as the player attempts to visit various individual homes to interrogate such individuals. The players enter an individual's home by moving their markers 19 over the squares of the roadway for a total number of squares not more than the number rolled on the die, it being understood that no two players may occupy any one street square or home at the same time. A player may pass another player on the roadway. A player does not have to travel down the roadway for the exact number of squares corresponding to the thrown number of the die but rather the player may move any number of squares up to that maximum number in order to reach the player's desired destination.

A player stopping on any of the corner squares 32, 33 or 34 draws the top card from the deck of cards associated with the square and places the drawn card face up in front of him. This card then becomes a "lead" which allows a player to throw again after interrogating an individual with it being understood that no player is permitted more than three consecutive throws on any one turn. A player may hold up to three of the cards 12, 13 and 14 with it being understood that a player must never hold more than one card of each of the decks of cards. By stopping on one of the corner squares, a player may exchange a card previously drawn for another card of the same deck, the player discarding the previously drawn card. The player may keep his cards as long as he only interrogates those individuals who have at least one "lead" imprinted on the portion 40*c* of square 40 which corresponds to the card that the player has. Should a player choose to interrogate an individual whose square 40 has no "leads" corresponding to any of the cards which the player has drawn, the player may not interrogate such individual unless the player chooses to permanently discard all of his present lead cards for the privilege of interrogating such individual. There is no limit to the number of times a player may draw cards from the decks 12, 13 and 14 with the only requirement being that a player can only draw cards from each deck when landing on the appropriate square 32, 33 and 34 on the game board, and the player may never hold more than one card from any one deck of cards.

To conduct an interrogation of an individual along the game board, the player must land on the roadway square to which the individual's house is adjacent, after which the player moves his token into the house indicating he wishes to interrogate such individual. The player detective then writes down the name of the individual in column 82 of the player's Notebook Sheet 17, after which the player lifts the flap 67 adjacent the individual's square 66 on the top surface 51 of Police File 15 to view through the associated opening 68 and see if the marking "S" 75 is presented therebeneath. If such marking "S" is seen, then the individual is considered a suspect and the letter "S" is entered on the player's Notebook Sheet 17 under the column marked "S" adjacent the individual's name. If no letter "S" appears next to the individual's name in the Police File, then a blank will appear and this indicates that such individual is innocent and is not a suspect. An individual is considered to be a suspect if the name of the individual contains one or more identical letters in the same position as the letters of the name of the murderer.

For example, if the name of the MURDERER was WALSH, and the name of the individual being interrogated was GALLOW, then the Police File would indicate the marking "S" 75 next to the name of GALLOW indicating that GALLOW was a suspect as it is to be noted that the letters "A" and "L" in both the names of the Murderer and the Suspect appear in the identical second and third positions respectively.

A further example of a suspect would be if the name of the Murderer was "BROWN" with the name of the suspect being "COHAN" as it is noted that the letter "N" in both names appears in the identical fifth position.

If an individual's name does not contain any identical letters in the same identical position as in Murderer's name, then the individual is considered innocent and is not a suspect. An example of this would be if the name of the Murderer were "HEINZ" with the name of the individual being interrogated being "IRWIN," with it being noted that there are no identical letters in identical positions in the names such that the individual is innocent. A similar example would be if the name of the murderer was "SMITH" with the name of the individual being interrogated being "YOUNG" with such individual being innocent and not being a suspect as the two names do not contain any identical letters in the identical positions.

When a player detective has entered an individual's home designated by a square 40 to interrogate the individual, the individual's name is recorded on the player's Notebook Sheet 17 under column 82 identified "NAMES" with each letter of the individual's name falling in one of the vertical columns numbered 1 through 5 respectively. Further, if the letter "S" is found next to the individual's name in the Police File 15, then such letter is also noted next to the name on the Notebook Sheet 17 in column 82 under the sub-column marked "S." The player then goes to the column 81 entitled "CHECK LIST" to indicate therein eliminated letters in the process of determining those letters making up the name of the murderer. For example, and as seen in FIG. 5, the individual interrogated by the player detective is named "GOMEZ," which the Police file 15 indicated to be innocent. Thus, as the individual is innocent, this means that none of the letters of the innocent individual's name corresponds to identically placed identical letters of the murderer's name so that such letters and their positions may be eliminated from further consideration in determining the name of the murderer. This is done by the player placing a mark, such as an asterisk 85, under the "CHECK LIST" 81 in the column 81*b* (first column) next to the letter "G," a mark in column 81*c* (second column) next to the letter "O," a mark in the column 81*d* (third column) next to the letter "M," a mark in the column 81*e* (fourth column) next to the letter "E," and a mark in the column 81*f* (fifth column) next to the letter "Z." The mark for the letter "Z" is seen in FIG. 5 with it being understood that the other columns mentioned above are similarly marked. During the next turn of the player detective, it is seen that the player interrogated the individual "SPREE" which was found in the Police File 15 to be a suspect such that the letter "S" was entered in the column "S." By deduction the player detective would know that the fourth letter in the murderer's name is not an "E" since such letter has been previously eliminated in the previous name "GOMEZ" which has the letter "E" in the fourth position the same as the name "SPREE," and as "GOMEZ" was not a suspect this meant that none of the letters of the name "GOMEZ" corresponded in position to any of the identical letters of the Murderer's name such that the "E" in the fourth position of the name "SPREE" is thus eliminated. On subsequent turns of the player, for purposes of illustration, the player has interrogated the names of "VERMA," "PHYFE" and "SHARP" with the Police File 15 indicating each of such names to be innocent such that the letters thereof were eliminated. By such elimination the player detective observes by crossing off the letters of the suspect's name "SPREE"

that the only letter remaining in the name "SPREE" which has not been eliminated by the names of the innocent individuals is the letter "P" found in the second position of the suspect's name. To further explain this, the first letter "S" of "SPREE" has been eliminated by the innocent name "SHARP;" the third letter "R" of "SPREE" has been eliminated by the innocent name "VERMA;" the fourth letter "E" of "SPREE" has been eliminated by the innocent name "GOMEZ;" and the fifth letter "E" of "SPREE" has been eliminated by the innocent name "PHYFE." Thus, only the second letter "P" of the suspect's name "SPREE" remains, with such letter being entered into its proper position in column 81*c* (second column) after the letter "P" of column 81*a*.

It is apparent that by using this procedure all of the letters of the Murderer's name will eventually appear under the "CHECK LIST" of column 81.

When a player detective determines from his Notebook Sheet 17 the name of the Murderer, or sufficient information for the player to make an attempted guess at the name, the player during his turn moves his marker 19 to the home of the Murderer and makes an accusation. At that time the player in secrecy lifts flap 70 of Police File 15 to expose the name of the Murderer through slot 71 and, if the player has correctly named the Murderer, he then shows the name to the other players and is declared the winner. However, if the player has incorrectly named the Murderer, then the player is out of the game and the game continues with the remaining players. The winner of the game is that player which correctly names the Murderer, or, alternatively, the winner is the last player in the game should all of the other players have attempted to accuse a Murderer and all have named an incorrect individual.

It is to be understood that the form of this invention herewith shown and described is to be taken as a preferred example of the same and that this invention is not to be limited to the exact arrangement of parts shown in the accompanying drawings or described in this specification as various changes in the details of construction as to shape, size and arrangement of parts may be resorted to without departing from the spirit of the invention, the scope of the novel concepts thereof, or the scope of the sub-joined claims.

Having thus described the invention, what is claimed is:

1. A homicide board game for playing by a plurality of players each assuming the roles of detectives, the players each following a multitude of clues to determine the murderer of a named murdered victim, the game comprising, in combination:

a first deck of information cards identified as Clue cards, the deck consisting of five identically shaped and configured rectangular flat cards each having a back side and a face side, the back side of each card being identical to prevent distinguishment of the cards from each other when placed with the face side down, the face side of each card each containing a different name of a clue imprinted thereon, the different clues being "GLOVE", "KEYS", "SCARF", "BLOOD" and "CAR";

a second deck of information cards identified as Weapon cards, the deck consisting of five identically shaped and configured rectangular flat cards each having a back side and a face side, the back side of each card being identical to prevent distinguishment of the cards from each other when placed with the face side down, the face side of each card each containing a different name of a weapon imprinted thereon, the different weapons being "KNIFE", "GUN", "AXE", "ROPE" and "POISON", the weapon cards being identical in configuration as the clue cards;

a third deck of information cards identified as Motive cards, the deck consisting of four identically shaped and configured rectangular flat cards each having a back side and a face side, the back side of each card being identical to prevent distinguishment of the cards from each other when placed with their face side down, the face side of each card each containing a different name of a motive imprinted thereon, the different motives being "JEALOUSY", "BLACKMAIL", "HATE" and "MONEY", the motive cards being identical in configuration as the clue cards and the weapon cards;

a plurality of Murderer Sheets each being of an identical flat rectangular configuration having a flat face surface and a flat back surface;

a flat, rectangularly shaped game board having a flat playing surface imprinted on a flat face surface thereof, a flat back surface, a top edge, a bottom edge, and opposed side edges, the game board divided into equal half portions and hinged along its central axis permitting the half portions to fold onto each other in face-to-face relationship for ease of storage and transportation of the game board, a first roadway extending continuously about the outermost periphery of the playing surface adjacent to the edges thereof and formed of a series of consecutive side-by-side rectangles defining playing spaces therealong, a second roadway substantially concentric with the first roadway and spaced inwardly therefrom and defining a general rectangular shape and formed of a series of consecutive side-by-side rectangles defining playing spaces which are substantially indentical to the first mentioned playing spaces, a plurality of spaced apart third roadways disposed between the first and second roadways and interconnecting portions of the first roadway to portions of the second roadway at spaced intervals completely about the playing surface, the third roadways each formed of a series of consecutive side-by-side rectangles defining playing spaces therealong which are substantially identical to the first and second mentioned playing spaces, there being disposed at intervals along the first, second and third roadways a multitude of squares designated as individual houses with each square having imprinted thereon an individual's name and a set of three "leads" selected one from each of the groups of clues, weapons and motives as found on the decks of cards defining each group, the combination of three "leads" being different for each of the named individuals such that none of the individuals' squares on the playing surface contain the same three "leads" thus making each square unique from each other individuals' square, three of the four corners of the playing surface of the game board being respectively identified by the marking imprinted thereon of "WEAPON", "MOTIVE" and "CLUE" with portions of the game board adjacent thereto being designated as positions on which the respective decks of Clue cards, Weapon cards, and Motive cards are intended to be stacked in a face-down manner for individual selection thereof by the players of the game during the play of the game;

a plurality of distinctive markers, one for each player of the game, for use by each player of the game to mark the player's position on the game board as the play of the game proceeds from player to player, each marker of a configuration to be readily received in any roadway rectangle or individuals' square to mark the players position thereon;

a chance device in the form of a conventional die for use in turn by each of the players in determining the length and position of each of the player's movements along the roadways of the game board playing surface as the player progress thereabout;

a player gaining access to an individual's square to interrogate the individual named thereon by landing on a roadway rectangle immediately adjacent such individual's square and on which the square faces;

a miniature figure in the form of a dead body for use in marking on the game board the name of the murdered victim for all players to clearly see and for which the murderer must be detected by the players, the player successfully detecting the name of the individual who murdered the victim being determined the winner of the game;

a police file container adapted to sit freely in the middle of the game board for ready access by each of the game players, the container having a flat horizontal top surface, a flat horizontal bottom surface, a vertical bottom end, opposed vertical side ends, and an open top end providing access therethrough to an open topped compartment formed interiorly of the container between the surfaces thereof, the compartment adapted to receive therein a plurality of the Murderer Sheets in a stacked relationship with the face surface of the topmost sheet facing upwardly, the top surface of the container is provided with a multitude of squares marked thereon with each of the squares having imprinted thereon an individual's name and street address corresponding to the individual's square on the game board, a slot shaped opening is formed in each of the squares opening through the container top surface in communication with the sheet compartment to provide visibility of a portion of the Murderer Sheet disposed in the compartment immediately adjacent the container top surface, a flap defining door member disposed in each of the slots and operative between a normally closed position closing the slot and preventing visibility of the murderer sheet therebelow and an open position providing selective viewability of the murderer sheet through the slot, a Murderer opening formed in the container top surface separate from the squares imprinted thereon and positioned to register with the name of the murderer found on the murderer sheet positioned beneath the container top surface, a flap defining door member disposed in the murderer opening and operative between a normally closed position closing the opening and preventing viewing of the name of the murderer and an open position disclosing the name of the murderer through the opening, a signal defining aperture formed in the container top surface and adapted to register with a portion of the murderer sheet disposed in the compartment immediately therebelow to provide a visual indication that the murderer sheet is properly inserted in the container compartment beneath the top surface preparatory to and during the play of the game;

the murderer sheets being plural in number with their being a murderer sheet prepared for each of the individuals named on the individual game board squares, the name of the individual on each sheet being imprinted on the face surface thereof in a position to register with the murderer opening in the container top surface upon the sheet being placed in the container compartment, marking indicia imprinted on each of the murderer sheet face surfaces in a position to register with the signal aperture of the container top surface to indicate the proper positioning of the murderer sheet in the container compartment when the sheet is inserted therein, a plurality of markings disposed about the face surface of each of the murderer sheets adapted to register with some of the slotted openings in the container top surface for viewability through such slots upon the opening of the flap door associated with such slot, the markings indicating those individuals which are suspect from those individuals which are innocent to thus provide clues for the players for the determination of the name of the murderer;

a plurality of detective notebook sheets each of a flat rectangular sheet of paper having a plurality of vertical and horizontal lines imprinted on a face surface thereof defining columns and rows of such columns, the sheets being for use in conjunction with appropriate indicia on the game board with one sheet assigned to each game player for listing thereon by the player the names of individuals interrogated by the player in an attempt to determine the name of the murderer with the use of information provided by successive use of the clue, weapon, and motive cards selected by the players for the purpose of logical development of the game purpose, each of the notebook sheets are of an identical shape and configuration having the face surface divided into three vertical columns identified, from left to right, as "CHECK LIST", "NAMES" and "NAMES", the "CHECK LIST" column is divided into six vertical sub-columns each of which is, in turn, difided by horizontal lines into at least 26 vertically arranged squares, the first sub-column on the left having the letters of the alphabet "A" through "Z" written in the squares thereof, the remaining five sub-columns each being identified at the head thereof by the numbers 1 through 5 respectively, each of the "NAMES" columns being identical and each divided into six vertical sub-columns with each sub-column divided by the same horizontal lines passing through the "CHECK LIST" column to provide at least 26 separate vertical squares for each column, the "NAMES" sub-column being identified, starting from the left, by the numbers 1–5 respectively for the first five columns with the sixth sub-column being identified by the letter "S", the name of each individual named on the game board has exactly five letters in the name such that an individual's name chosen to be interrogated by a player is written into the first five sub-columns of a "NAMES" column with the marking "S" placed in the "S" sub-column if such interrogated individual's name indicates on the police file container as being a suspect as indicated by a marking on the murderers sheet disposed in the container compartment and exposed through one of the openings in the top member of the police file;

there being a like number of separate individuals' squares on the game board as there are individuals listed on the police file container top surface as there are murderers' sheets each corresponding to one of the named individuals;

each individual has uniquely associated therewith on the individual square of the game board three "leads" with one of the leads corresponding to a Clue card, one of the leads corresponding to a Weapon card, and one of the leads corresponding to a Motive card; and whereby a murderer sheet is picked at random with the murderer name hidden, the sheet placed in the container compartment beneath the top surface thereof with the indicia on the sheet in registration with the openings in the container, a detective sheet is assigned to each player for the players use along with one of the markers, and the die is tossed by each player in turn as they progress along the roadways and interrogate individuals on the game board as they progress thereabout to determine the name of the murderer, the first player to do so being determined the winner.

* * * * *